US007861680B2

(12) United States Patent
Diggs

(10) Patent No.: US 7,861,680 B2
(45) Date of Patent: Jan. 4, 2011

(54) PUSHROD ENGINE WITH MULTIPLE INDEPENDENT LASH ADJUSTERS FOR EACH PUSHROD

(75) Inventor: Matthew Byrne Diggs, Farmington, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 131 days.

(21) Appl. No.: 12/183,230

(22) Filed: Jul. 31, 2008

(65) Prior Publication Data

US 2008/0283011 A1 Nov. 20, 2008

Related U.S. Application Data

(63) Continuation of application No. 11/539,238, filed on Oct. 6, 2006, now Pat. No. 7,424,876.

(51) Int. Cl.
*F01L 1/18* (2006.01)

(52) U.S. Cl. ..... 123/90.41; 123/90.39; 123/90.44; 123/90.45; 123/90.61; 74/569

(58) Field of Classification Search ..... 123/90.39, 123/90.44, 90.2, 90.16, 90.41, 90.45, 90.61; 74/559, 567, 569

See application file for complete search history.

(56) References Cited

U.S. PATENT DOCUMENTS

| | | | |
|---|---|---|---|
| 3,353,523 | A | 11/1967 | Meden et al. |
| 3,757,749 | A | 9/1973 | Hatz |
| 3,884,199 | A | 5/1975 | Irimajiri et al. |
| 4,393,820 | A | 7/1983 | Maki et al. |
| 4,476,822 | A | 10/1984 | Bonvallet |
| 4,763,616 | A | 8/1988 | Grindsteiner |
| 4,934,323 | A | 6/1990 | Grinsteiner |
| 5,022,361 | A | 6/1991 | Schut |
| 5,038,726 | A | 8/1991 | Pryba |
| 5,213,074 | A | 5/1993 | Imagawa et al. |
| 5,490,485 | A | 2/1996 | Kutlucinar |
| 5,560,265 | A | 10/1996 | Miller |
| 5,617,818 | A | 4/1997 | Luders |
| 5,657,726 | A | 8/1997 | Diggs |
| 5,732,670 | A | 3/1998 | Mote |
| 5,809,956 | A | 9/1998 | Regueiro |
| 5,862,785 | A | 1/1999 | Blowers et al. |
| 5,983,849 | A | 11/1999 | Wangen et al. |
| 6,047,675 | A | 4/2000 | Kunz |
| 6,273,042 | B1 | 8/2001 | Perez et al. |
| 6,484,682 | B2 | 11/2002 | Danesh et al. |
| 6,513,472 | B2 | 2/2003 | Speil et al. |
| 6,659,056 | B2 | 12/2003 | Sweetland |
| 6,953,016 | B2 | 10/2005 | Karbstein et al. |
| 6,962,134 | B1 | 11/2005 | Douse |
| 7,096,850 | B2 | 8/2006 | Yashirodai et al. |
| 7,134,411 | B2 | 11/2006 | Lancefield et al. |
| 2002/0062805 | A1 | 5/2002 | Durr et al. |
| 2005/0056242 | A1 | 3/2005 | Murata et al. |

*Primary Examiner*—Ching Chang
(74) *Attorney, Agent, or Firm*—Julia Voutyras; Brooks Kushman P.C.

(57) ABSTRACT

A multiple-cylinder internal combustion engine having a camshaft-driven valvetrain with a camshaft disposed within an engine block includes at least two intake and/or exhaust valves with multiple valves operated by a common lifter and pushrod that engages a follower having multiple independent lash adjusters coupled to associated rocker arms. The lifter contacts the common camshaft lobe and a corresponding pushrod that engages a reciprocating bucket follower with a compliant coupling to corresponding rocker arms.

15 Claims, 3 Drawing Sheets

PUSHROD ENGINE WITH MULTIPLE INDEPENDENT LASH ADJUSTERS FOR EACH PUSHROD

CROSS-REFERENCE TO RELATED APPLICATION

This application is a continuation of, and claims priority under 35 USC §120 to, commonly owned and copending U.S. patent application Ser. No. 11/539,238 filed on Oct. 6, 2006, now U.S. Pat. No. 7,424,876.

BACKGROUND

1. Technical Field

The present disclosure relates to multiple-cylinder internal combustion engines having intake and/or exhaust valves operated by a camshaft positioned in an engine block with an associated valvetrain.

2. Background Art

Conventional internal combustion engines use a camshaft-driven valvetrain to operate intake and exhaust valves that control the exchange of gases in the combustion chambers formed between the engine block and cylinder head. Engines are often categorized by the location of the camshaft relative to the valves, with overhead cam valvetrains driven by a camshaft in the cylinder head over the valves, and pushrod valvetrains or "cam-in-block" valvetrains having the camshaft located in the engine block with the valves operated using pushrods and rocker arms.

Current four-valve-per-cylinder pushrod engines include two intake valves and two exhaust valves for each cylinder. Each pair of valves is operated in tandem by a bridged valvetrain that includes a camshaft-driven cam follower (also referred to as a tappet or lifter) connected by a single pushrod to a rocker arm that drives a bridge coupled to the pair of valves (intake or exhaust). This bridged valvetrain is a cost-efficient design that achieves acceptable performance for many applications, although operation of the two bridged valves is not precisely synchronized because the force exerted on the bridge can not be perfectly balanced between the valves, the valves may have slightly different spring forces, and the valve components may experience slightly different wear. This may result in one valve opening late and/or one valve may seat first while closing causing the other valve to seat late with a higher than intended velocity. In addition, valve stem tips are edge loaded by the bridge with higher stresses resulting in higher rates of wear and potential noise, vibration, and harshness (NVH) concerns. While single overhead cam (SOHC) and dual overhead cam (DOHC) systems have independently controlled valves to address some of these issues, the SOHC and DOHC systems are significantly more expensive and have large package width relative to a cam-in-block design.

To provide various advantages over conventional pushrod, SOHC, and DOHC engines, an engine and valvetrain having dual pushrod lifters and independent lash adjustment has been developed as described in commonly owned and copending U.S. patent application Ser. No. 11/164,620 filed Nov. 30, 2005. While suitable for many applications, the number of pushrods utilized may impose packaging constraints on port placement in the cylinder head.

SUMMARY OF THE DISCLOSURE

A multiple-cylinder internal combustion engine having a camshaft-driven valvetrain with a camshaft disposed within an engine block includes at least two valves operated by a common camshaft lobe and an associated lifter coupled to at least one pushrod that actuates a bucket follower associated with at least two rocker arms to actuate the at least two valves.

Embodiments include a lifter engaging a single pushrod coupled to an associated bucket follower having multiple independent hydraulic lash adjusters (HLA's) for driving multiple valves associated with a single cylinder with the same timing.

A method for actuating at least two gas exchange valves associated with a single cylinder in a multiple-cylinder internal combustion engine having a camshaft disposed within an engine block includes actuating the at least two gas exchange valves substantially simultaneously using a single pushrod and at least two corresponding rocker arms coupled to a common follower. The common follower may independently adjust lash associated with the pushrod, rocker arms, and actuated valves.

A number of advantages are associated with an engine/valvetrain consistent with the present disclosure. For example, embodiments having a dedicated lash adjuster for each valve associated with a particular pushrod/lifter compensate for thermal, wear, and tolerance effects to ensure that the valve motion remains very close to the design intent throughout the life of the engine. A common lifter and pushrod for tandem valve operation with independent lash adjusters should reduce or eliminate noise, vibration, and harshness associated with multiple valves failing to open or close together and/or having different or higher than intended seating velocities. The present disclosure provides coupled, synchronous motion for associated valves and allows individual compensation for valve spring force differences, differences in valve/seat wear, and differences due to the rocker arm force not being applied at the mid-point between valve centerlines which is liable to occur using a valve bridge design, for example. In addition, the strategies described in the present disclosure eliminate wear mechanisms associated with bridged valvetrain implementations, such as pitching and rolling of the bridge resulting in increased stresses on the bridge/rocker arm interface resulting in undesirable contact between the bridge and valve stem tips. Use of a single pushrod to actuate multiple valves with independent hydraulic lash adjustment reduces package width of the pushrods to provide improved packaging of ports in the cylinder head.

The above advantages and other advantages and features of associated with the present disclosure will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features illustrated and described with reference to any one of the Figures may be combined with features illustrated in one or more other Figures to produce embodiments that are not explicitly illustrated or described. The combinations of features illustrated provide representative embodiments for typical applications. However, various combinations and modifications of the features consistent with the teachings of this disclosure may be desired for particular applications or implementations.

Figure 1:
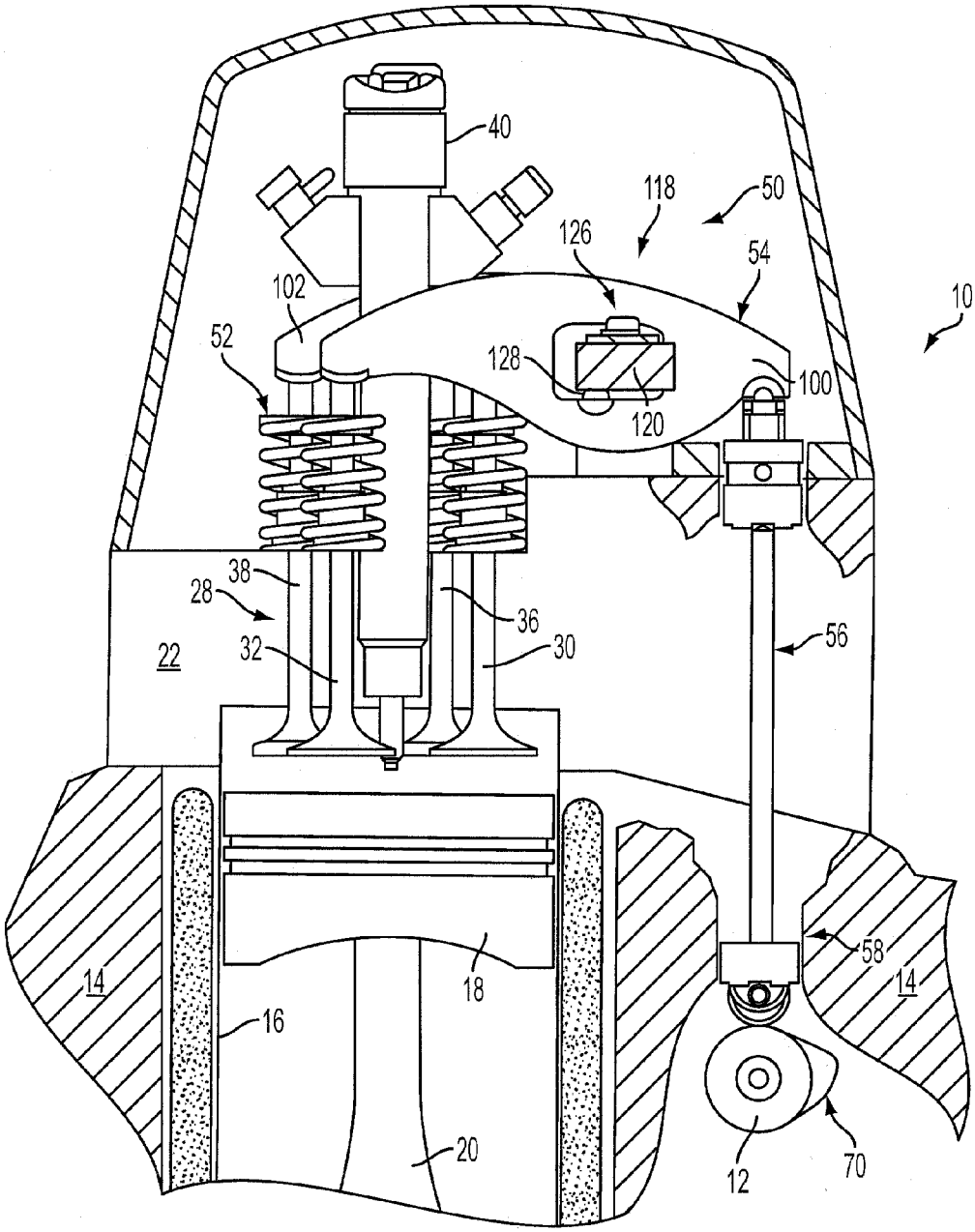
FIG. 1 illustrates a valvetrain with a lifter engaging a single pushrod with a dual bucket follower in an internal combustion engine according to one embodiment.
Figure 2:
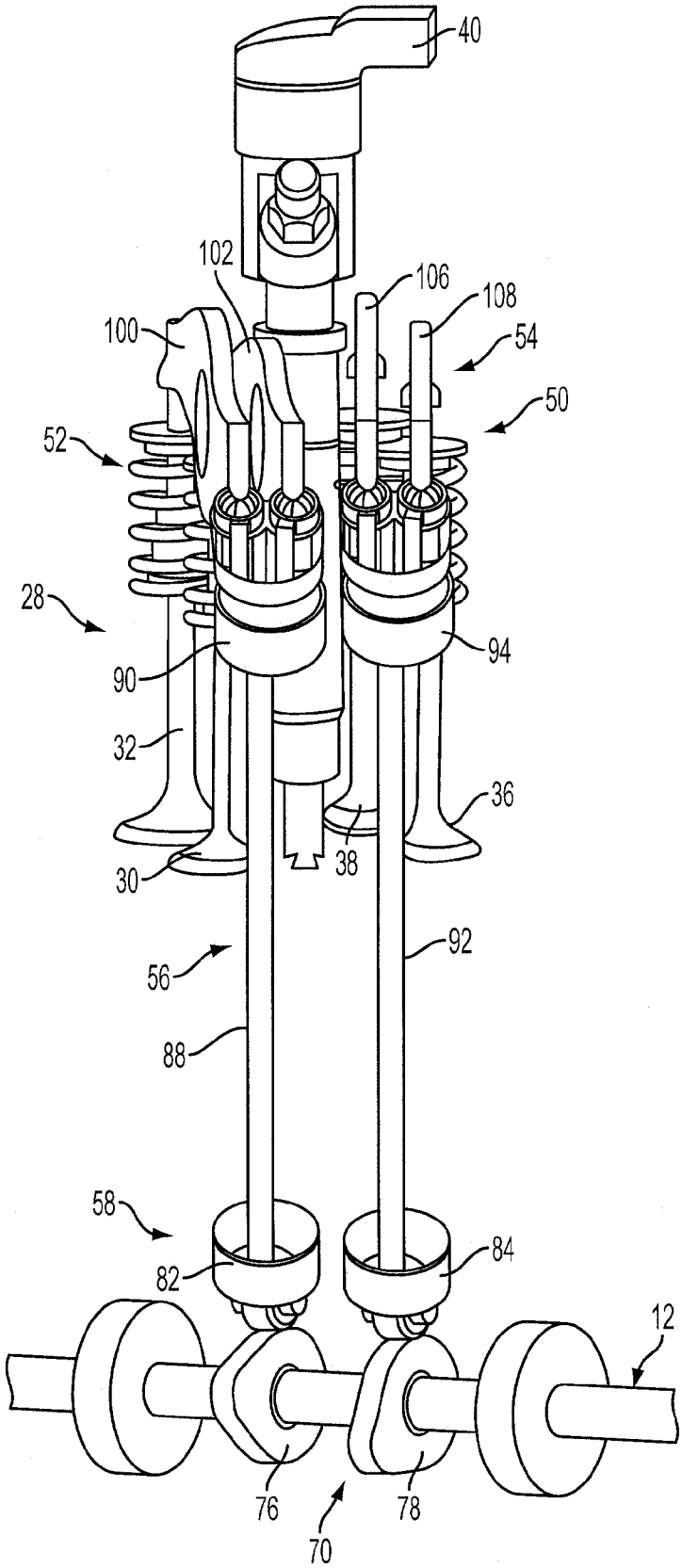
FIG. 2 is a perspective view of a representative embodiment of a four valve per cylinder valvetrain with each pushrod actuating multiple valves with independent lash adjustment.
Figure 3:
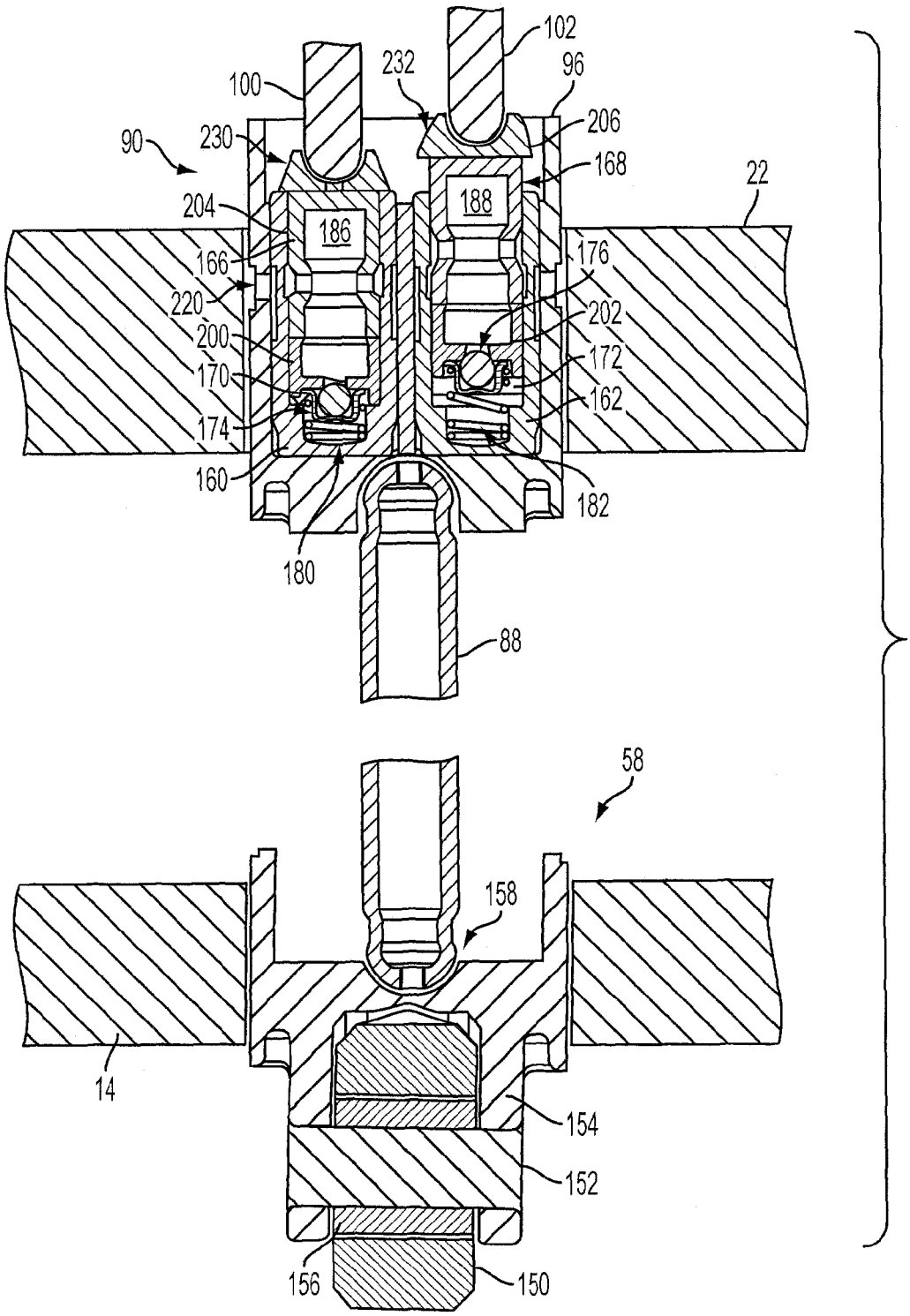
FIG. 3 is cross-section illustrating operation of an embodiment having a dual hydraulic lash adjuster actuated by a single pushrod.

FIGS. 1-3 illustrate operation of an internal combustion engine and valvetrain according to a representative embodiment. Multiple-cylinder internal combustion engine 10 is generally of conventional design with the exception of various valvetrain components as described herein. As such, various conventional features associated with the engine and valvetrain are not explicitly illustrated or described. Those of ordinary skill in the art will recognize that the disclosed valvetrain features may be used in various types and configurations of engines including but not limited to compression ignition and spark ignition engines arranged in a "V" configuration or an in-line configuration, for example. The representative embodiments illustrated include a four valve per cylinder compression ignition engine. However, the teachings of the present disclosure may be used in any applications having multiple intake/exhaust valves controlled simultaneously by a single camshaft lobe and single pushrod. Similarly, while the representative embodiments include independently operable hydraulic lash adjusters, the teachings of the present disclosure may also be applied to a valvetrain having mechanical lash adjustment.

Multiple-cylinder internal combustion engine 10 includes a camshaft 12 disposed within an engine block 14, and may be referred to as a cam-in-block or pushrod engine. Each cylinder 16 (only one of which is shown) includes a reciprocating piston 18 coupled by a connecting rod 20 to a crankshaft (not shown). Cylinder head 22 is secured to engine block 14 and provides conventional intake and exhaust passages (not shown) coupled to corresponding ports (not shown) in cylinder head 22 associated with gas exchange valves 28, which include intake valves 30, 32 and exhaust valves 36, 38. Cylinder head 22 includes conventional hardware such as valve guides, seats, etc. (not shown) associated with operation of gas exchange valves 28. A fuel injector 40 delivers fuel to cylinder 16 in response to a signal provided by an associated engine controller. Although a direct injection engine is illustrated in FIG. 1, the disclosed valvetrain may be used in engines having other fuel injection strategies including, but not limited to port injection, for example.

Engine 10 includes a valvetrain 50 to control intake of air and/or fuel (for port injected engines) into cylinder 16 and exhaust of combustion gases. Valvetrain 50 includes valves 28, valve springs 52, rocker arms 54, pushrods 56, and lifters 58, sometimes referred to as tappets or cam followers. As best illustrated in FIG. 2, camshaft 12 includes lobes 70 to actuate valves 28. For each cylinder 16, camshaft 12 includes a lobe 76 to operate associated intake valves 30, 32 and a lobe 78 to operate associated exhaust valves 36 and 38. In the representative embodiments illustrated in FIGS. 1-3, cam lobe 76 has an associated lifter 82 coupled to a single corresponding pushrod 88 that drives a corresponding bucket follower 90 associated with multiple rocker arms 100, 102 to actuate corresponding multiple intake valves 32, 30 in tandem. Similarly, cam lobe 78 has an associated lifter 84 coupled to a single corresponding pushrod 92 that drives a corresponding bucket follower 94 associated with multiple rocker arms 106, 108 to actuate corresponding multiple exhaust valves 36, 38.

Lifters 82, 84 reciprocate within corresponding bores in engine block 14 driven by lobes 70 of camshaft 12 and include an orientation or anti-rotation feature (not shown), such as a flat or key, to prevent rotation within the bore. Similarly, bucket followers 90, 94 reciprocate within corresponding bores that may be positioned in cylinder head 22, fulcrum 126, and/or a separate carrier (not shown) attached to cylinder head 22 and/or fulcrum 126. Bucket followers 90, 94 also include an anti-rotation feature that allows sliding engagement while preventing rotation within the bore. As described in greater detail with reference to FIG. 3, each bucket follower 90, 94 may include independently operable hydraulic lash adjusters to adjust lash associated with the pushrod and tandem-driven rocker arms and valves. The interface between the rocker arms (100, 102; 106, 108) and corresponding lash adjusters of bucket followers 90, 94 is preferably a compliant coupling, such as an "elephant foot" or similar device known to those of ordinary skill in the art and described in greater detail with reference to FIG. 3.

In operation, lifter 82 contacts lobe 76 of camshaft 12. As camshaft 12 rotates, lobe 76 raises lifter 82 and associated pushrod 88 that exerts corresponding forces on bucket follower 90 and associated rocker arms 100, 102. Each rocker arm 100, 102 pivots in a single plane about an integral ball/socket fulcrum or pivot point 120 with the ball supported by an associated fulcrum 126 secured to cylinder head 22 as known in the art. Rocker arms 100, 102 translate the generally upward motion from pushrod 88 and bucket follower 90 to a generally downward motion to move intake valves 30, 32 against associated springs 52 to open the intake ports. As camshaft 12 continues rotating, lifter 82 follows the profile of lobe 76 and begins a generally downward motion so that the associated springs 52 close intake valves 30, 32. Actuation of exhaust valves 36, 38 proceeds in a similar manner based on the profile of lobe 78, which actuates lifter 84, pushrod 92, bucket follower 94, and rocker arms 106, 108.

As illustrated in FIGS. 1-3, a method for operating engine 10 and valvetrain 50 includes actuating at least two gas exchange valves, such as intake valves 30, 32 or exhaust valves 36, 38, substantially simultaneously using a single corresponding pushrod (88 or 92) and rocker arms (100, 102; or 106, 108) coupled to a common lifter (82 or 84). As illustrated and described with reference to FIG. 3, each bucket follower 90, 94 may include multiple independently operable hydraulic lash adjusters to independently adjust lash associated with the common pushrod and corresponding rocker arm and valve assembly. Alternatively, mechanical lash adjustment may be provided with a single pushrod and lifter actuating two or more lash adjusters and associated rocker arms. Conventional mechanical lash adjustment may use a screw adjuster at the rocker arm on the pushrod end. The pushrod is typically a ball-cup end with the rocker arm adjuster screw having a ball end locked in position with a nut.

FIG. 3 is a cross-section illustrating a representative bucket follower having at least two independent hydraulic lash adjusters that engages a single pushrod and lifter for use in a valvetrain according to the present disclosure.

Lifter 58 is a cam follower or tappet that includes a roller 150 mounted for rotation about an axle 152 secured to housing or body 154. A bearing 156 or similar device facilitates rotation of roller 150 about axle 152 when in contact with a corresponding camshaft lobe. Housing 154 reciprocates within a corresponding bore in engine block 14 in response to the camshaft position. Housing 154 includes a cup or socket 158 that engages a corresponding ball or hemispherical surface of pushrod 88. An opposite end of pushrod 88 engages a corresponding socket or recess in bucket follower 90, which includes independently operable hydraulic lash adjustment mechanisms that engage corresponding rocker arms 100, 102.

Bucket follower 90 includes a housing 96 with multiple axial bores having corresponding sleeves 160, 162 fixed therein and each having a closed end and an open end. Each sleeve 160, 162 includes an axially movable plunger 200, 202 disposed therein to define a variable volume high-pressure chamber 170, 172 between the closed end and the plunger. Check valves 174, 176 are disposed within corresponding high pressure chambers 170, 172 to control flow of hydraulic fluid from reservoirs 186, 188 disposed within plungers 166, 168 into chambers 170, 172. Springs 180, 182 act on associated plungers 166, 168 to reduce lash when hydraulic pressure is reduced, such as during the base circle duration, for example.

Bucket follower 90 includes two-part plungers 166, 168 with a lower plunger member or base 200, 202 and an upper plunger member or coupling 204, 206. Upper plunger members 204, 206 may include various geometries to facilitate compliant engagement/coupling with corresponding geometries of rocker arms 100, 102. In the representative embodiment illustrated in FIG. 3, rocker arms 100, 102 include respective elephant foot couplings 230, 232 that provide a pivotable flat surface that engages upper plunger members 204, 206. Various alternative coupling devices may be provided. For example, an elephant foot coupling attached to upper plunger members 204, 206 may be used, or each rocker arm 100, 102 may have a curved pad similar to the conventional valve tip pad with the upper plunger members 204, 206 having flat or slightly crowned spherical surfaces. In the latter case, the upper plunger members preferably include a spherical radius that is significantly larger than a conventional HLA plunger radius, i.e. 800 mm rather than 4.5 mm for a conventional HLA plunger. Similarly, the lash adjuster/rocker arm interface may be implemented using a flat rocker arm pad with a slightly crowned spherical surface on the corresponding HLA plunger. Those of ordinary skill in the art may recognize various other compliant couplings consistent with the teachings of this disclosure that are suitable in particular applications.

In operation, independent mechanical or hydraulic lash adjusters essentially eliminate any lash or clearance between the valve train components under varying operating and ambient conditions to provide consistent and reliable valve actuations including repeatable valve opening and closing times and peak lift values. As the length of an associated pushrod varies due to temperature variation or wear, hydraulic fluid from a pressurized supply enters bucket follower 90 through a transverse bore 220 in housing 96 and enters reservoirs 186, 188. A small amount of hydraulic fluid passes through check valves 174, 176 into high-pressure chambers 170, 172 moving plungers 166, 168 away from closed end of sleeves 160, 162 to remove any lash or clearance between couplers 204, 206 and corresponding rocker arms 100, 102. As such, the force generated by the cam lobe rotating in contact with roller 150 is transferred through housing 154 and pushrod 88 to housing 96 and sleeves 160, 162, then through the hydraulic fluid within chambers 170, 172 to plungers 166, 168. If pushrod 88 increases in length due to thermal expansion, hydraulic fluid escapes very slowly from chambers 170, 172 between plungers 166, 168 and sleeves 160, 162 to reduce the volume contained within an associated pressure chamber 170 or 172.

The multiple lash adjusters associated with each bucket follower 90 operate independently from one other to more precisely synchronize actuation of multiple valves associated with a single lifter and pushrod as compared to a bridged implementation using a single pushrod and lash adjuster. As such, the individual lash compensation accommodates variations in valve spring force, valve and/or valve seat wear, thermal effects, etc. to provide coupled, synchronous motion for each valve pair. Use of a single pushrod to actuate multiple gas exchange valves for a particular cylinder provides more flexibility in positioning intake/exhaust ports due to the reduced packaging space required. As such, embodiments consistent with the present disclosure provide a pushrod or cam-in-block engine/valvetrain that includes hydraulic lash adjustment at each valve location.

While the best mode for carrying out the invention has been described in detail, those familiar with the art to which this invention relates will recognize various alternative designs and embodiments for practicing the invention as defined by the following claims.

What is claimed:

1. An engine comprising:

a lifter contacting a common camshaft lobe;

only one single pushrod associated with each lifter;

a follower having at least two independent hydraulic lash adjusters and engaging the single pushrod and at least two rocker arms, each rocker arm actuating a different one of at least two valves and moving the valves in the same direction at substantially the same time to open or close the valves.

2. The engine of claim 1 wherein the follower comprises:

a bucket follower and wherein each lash adjuster engages a corresponding rocker arm.

3. The engine of claim 1 wherein the at least two independent hydraulic lash adjusters comprise:

at least two independent hydraulic lash adjustment mechanisms, each lash adjustment mechanism having a compliant coupling engaging an associated rocker arm.

4. The engine of claim 1 wherein the at least two independent hydraulic lash adjusters comprise:

at least two independent hydraulic lash adjustment mechanisms and wherein at least one of the adjustment mechanisms and the rocker arms includes a pivotable surface.

5. The engine of claim 1 wherein the follower comprises:

a housing;

a first sleeve disposed within a first bore in the housing and having a closed end and an open end;

a first plunger disposed within the first sleeve and defining a first high-pressure chamber between the closed end and the first plunger;

a first check valve disposed between the first plunger and the first sleeve for controlling flow of hydraulic fluid from the first plunger into the first high-pressure chamber, the hydraulic fluid in the high-pressure chamber along with the plunger spring operating to remove lash associated with the push rod, a first rocker arm, and a first valve;

a second sleeve disposed within a second bore in the housing and having a closed end and an open end;

a second plunger disposed within the second sleeve and defining a second high-pressure chamber between the closed end and the second plunger; and a second check valve disposed between the second plunger and the second sleeve for controlling flow of hydraulic fluid from the second plunger into the second high-pressure chamber, the hydraulic fluid in the second high-pressure chamber along with the plunger spring operating to remove lash associated with the push rod, a second rocker arm, and a second valve.

6. The engine of claim 1 wherein the follower reciprocates within a bore at least partially disposed within a cylinder head.

7. The engine of claim 1 wherein the follower reciprocates within a bore disposed within a fulcrum mounted to a cylinder head.

8. A multiple-cylinder internal combustion engine comprising:

a camshaft disposed within an engine block and having at least first and second cam lobes for actuating at least four valves associated with a corresponding one of the cylinders;

at least two intake valves and at least two exhaust valves associated with each cylinder;

a first lifter in contact with the first cam lobe;

a first pushrod associated with the first lifter;

a first follower engaging the first pushrod and reciprocating within a corresponding bore in response thereto; and at least two rocker arms actuated by the first follower, each rocker arm actuating a different one of the at least two intake valves to move the at least two intake valves in the same direction at substantially the same time in response to rotation of the first cam lobe to open and close the at least two intake valves.

9. The engine of claim 8 wherein the first follower comprises:

a bucket follower having at least two independent lash adjusters associated with each pushrod, each lash adjuster engaging a corresponding rocker arm.

10. The engine of claim 8 wherein the first follower comprises:

at least two independent hydraulic lash adjustment mechanisms, each lash adjustment mechanism having a compliant coupling engaging an associated rocker arm.

11. The engine of claim 8 wherein the first follower comprises:

at least two independent hydraulic lash adjustment mechanisms and wherein at least one of the adjustment mechanisms and the rocker arms includes a pivotable surface.

12. The engine of claim 8 further comprising:

a second lifter in contact with the second cam lobe;

a second pushrod associated with the second cam lobe;

a second follower engaging the second pushrod and reciprocating within a corresponding bore in response thereto; and at least two rocker arms actuated by the second follower, each rocker arm actuating a different one of the at least two exhaust valves to move the at least two exhaust valves in the same direction at substantially the same time in response to rotation of the second cam lobe to open and close the at least two exhaust valves.

13. The engine of claim 12 wherein the second follower comprises:

a bucket follower having at least two independent lash adjusters associated with each pushrod, each lash adjuster engaging a corresponding rocker arm.

14. The engine of claim 12 wherein the second follower comprises:

at least two independent hydraulic lash adjustment mechanisms, each lash adjustment mechanism having a compliant coupling engaging an associated rocker arm.

15. The engine of claim 12 wherein the second follower comprises:

at least two independent hydraulic lash adjustment mechanisms and wherein at least one of the adjustment mechanisms and the rocker arms includes a pivotable surface.

* * * * *